US006260444B1

(12) United States Patent
Junkers

(10) Patent No.: US 6,260,444 B1
(45) Date of Patent: Jul. 17, 2001

(54) POWER TOOL

(76) Inventor: John K. Junkers, 7 Arrowhead La., Saddle River, NJ (US) 07540

( * ) Notice: Subject to any disclaimer, the term of this patent is extended or adjusted under 35 U.S.C. 154(b) by 0 days.

(21) Appl. No.: 09/338,616

(22) Filed: Jun. 23, 1999

(51) Int. Cl.[7] ..... B25B 13/46
(52) U.S. Cl. ..... 81/57.39; 81/57.13
(58) Field of Search ..... 81/57.13, 57.14, 81/57.29, 57.3, 57.39

(56) References Cited

U.S. PATENT DOCUMENTS

| | | | | |
|---|---|---|---|---|
| Re. 33,951 | | 6/1992 | Junkers . | |
| 3,791,242 | * | 2/1974 | Bartusch | 81/57.39 X |
| 4,325,274 | * | 4/1982 | Martelee | 81/57.39 X |
| 4,346,630 | * | 8/1982 | Hanson | 81/57.39 X |
| 4,380,857 | | 4/1983 | Yamazaki . | |
| 4,794,826 | | 1/1989 | Franks . | |
| 5,003,847 | | 4/1991 | Wagner . | |
| 5,005,447 | | 4/1991 | Junkers . | |
| 5,029,497 | | 7/1991 | Junkers . | |
| 5,388,478 | | 2/1995 | Castle . | |
| 5,953,966 | * | 9/1999 | Spirer | 81/57.39 X |
| 6,029,546 | * | 2/2000 | Gibson et al. | 81/57.39 X |

* cited by examiner

*Primary Examiner*—James G. Smith
(74) *Attorney, Agent, or Firm*—Michael J. Striker

(57) ABSTRACT

A power tool for tightening and loosening threaded connectors has a link having a link housing and a ratchet unit for turning an engaging element so as to turn a threaded connector engaged by the engaging element, a first hydraulic drive unit including a drive housing and a hydraulically movable driving element, a non-hydraulic drive unit including a drive housing and non-hydraulically moveable driving element, a first connection provided on the link housing and on the drive housing of the hydraulic drive unit and the non-hydraulic drive unit, so that alternatingly either the housing of the hydraulic drive unit or the housing of the non-hydraulic drive unit can be connected with the link housing, and a second connection for connecting the ratchet mechanism alternatingly with the driving element of the hydraulic drive unit or the driving element of the non-hydraulic drive unit, so that the driving element of the hydraulic drive unit and alternatingly the driving element of the non-hydraulic drive unit during its movement turns the ratchet mechanism of the link and thereby turns a threaded connector engaged by the engagement element of the link to be tightened or loosened.

1 Claim, 4 Drawing Sheets

POWER TOOL

BACKGROUND OF THE INVENTION

The present invention relates generally to power tools for tightening and loosening threaded connectors.

More particularly, it relates to such power tools which have a housing, engaging means for engaging a threaded connector to be tightened and loosened, a ratchet mechanism for turning the engaging means so as to turn a threaded connector engaged by the latter, and a drive which acts on the ratchet means so as to turn the ratchet means together with the engaging means and thereby to turn the threaded connector.

Such power tools are known in the art. The drive means for such power tools can be hydraulically-operated drive means, for example as disclosed in my U.S. Pat. Nos. 5,005,447; 5,029,497; RE.33,951, etc. These tools operate only in conjunction with hydraulic power. There are however many applications where a customer does not require the torque accuracy provided by the hydraulically-operated power tools of this kind or the power provided by hydraulics. Instead, the customer will prefer, instead of using the hydraulically-operated drive power tool which requires more side and overhead clearance, to use a limited clearance tool without having to go into hydraulics. In other instances, the customer seeks a higher torque output than the one provided with its present tool.

SUMMARY OF THE INVENTION

Accordingly, it is an object of the present invention to provide a power tool which avoids the disadvantages of the prior art and is a further improvement of the existing tools.

In keeping with these objects and with others which will become apparent herein after, one feature of present invention resides, briefly stated, in a power tool which has a link having a link housing, engaging means for engaging a threaded connector to be tightened and loosened, and ratchet means for turning the engaging element so as to turn a threaded connector engaged by the engaging means; first hydraulic drive means including a drive housing, and a hydraulically operated drive provided with a hydraulically movable driving element; and non-hydraulically drive means including a drive housing, and a non-hydraulic operated drive provided with a non-hydraulically moveable driving element; first connecting means provided on the link housing and on the drive housing of the hydraulic drive means and the non-hydraulic drive means, so that alternatingly either the housing of the hydraulic drive means or the housing of the non-hydraulic drive means can be connected with the link housing; and second connecting means for connecting the ratchet mechanism alternatingly with the driving element of the hydraulic drive means or the driving element of the non-hydraulic drive means when the drive housing of the hydraulic drive means is connected with the link housing or the drive housing of the non-hydraulic drive means is connected with the link housing correspondingly, so that the driving element of the hydraulic drive means and alternatingly the driving means of the non-hydraulic drive means during its movement turns the ratchet mechanism of the link and thereby turns a threaded connector engaged by the engagement means to be tightened or loosened.

When the power tool is designed in accordance with the present invention, a customer can use the hydraulically-operated drive means in combination with the link to operate with the hydraulically-operated power tool. At the same time, when needed, it can use a non-hydraulically operated drive means in combination with the link so as to use a non-hydraulically operated power tool. The thusly formed non-hydraulically operated power tool which utilizes a cam also provides an input/output advantage and is relatively inexpensive. Also, it can be powered by manual torque wrenches, cheater bars, manual multiplers, air multiplers, air wrenches, electricwrenches, electric multiplers, impactwrenches, etc, which customers already have in their possession. The present invention provides an economical alternative for the industry to multiple their tools output force or to convert their square drive tools to limited clearance hex 8-point or 12-point tools. It also permits the customers to start with their tools on hand and to convert latter to hydraulics if so required.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
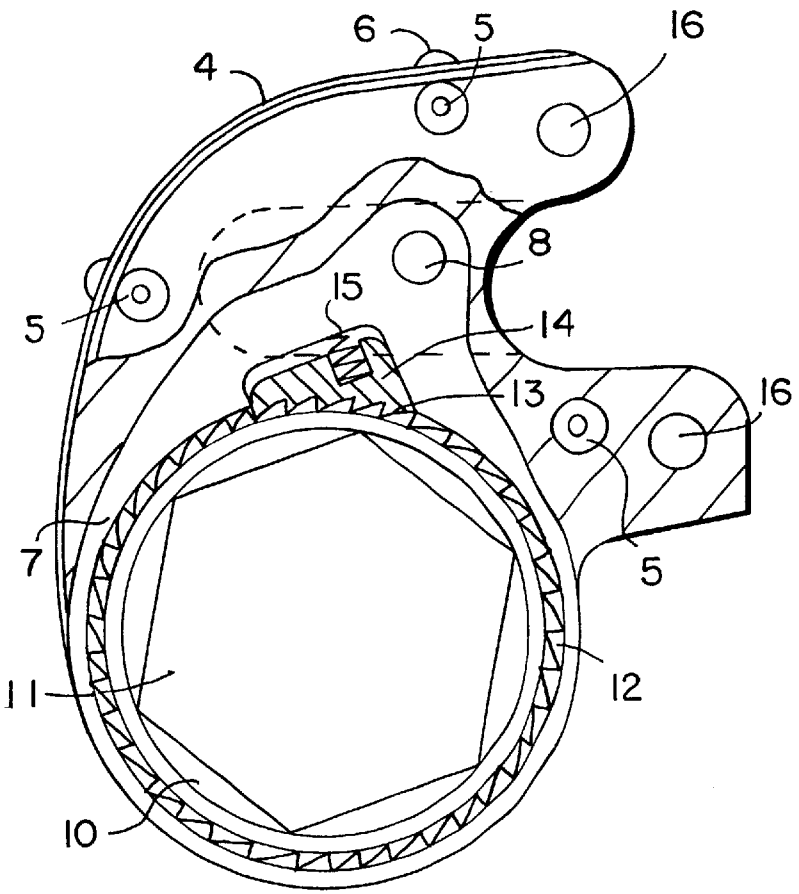
FIGS. 1 and 2 are a plan view and a side view of a link of a power tool in accordance with the present invention.
Figure 2:
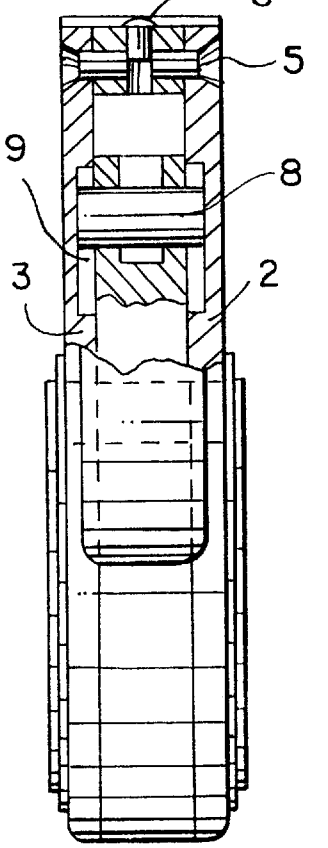
Figure 3:
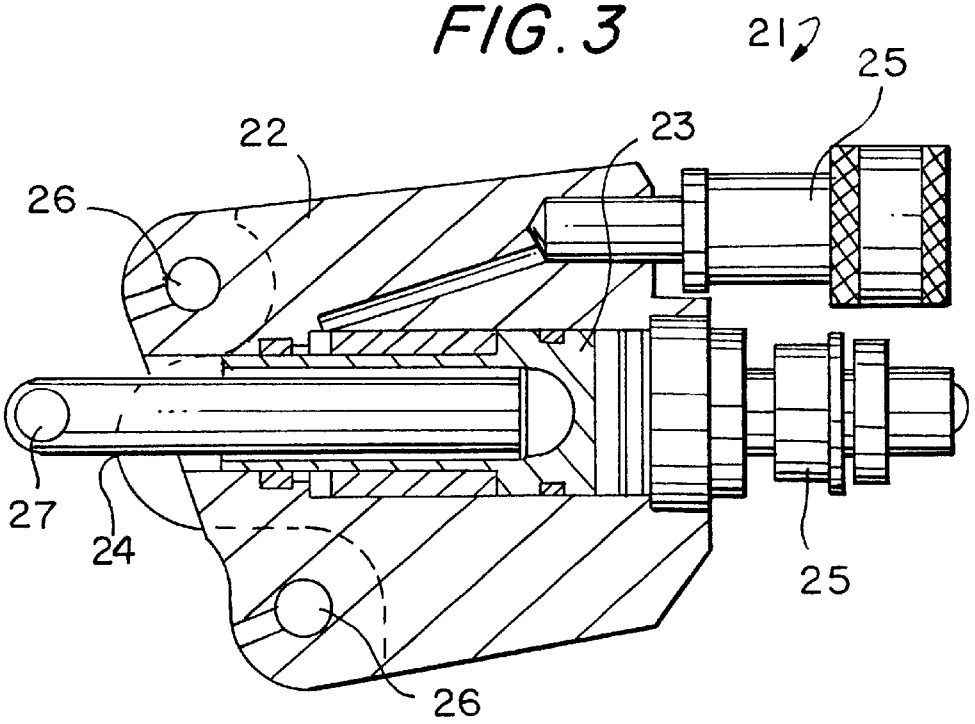
FIGS. 3 and 4 is a front view and a side view of first drive means of the inventive power tool.
Figure 4:
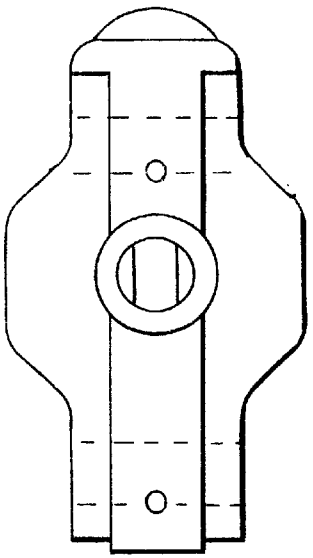
Figure 5:
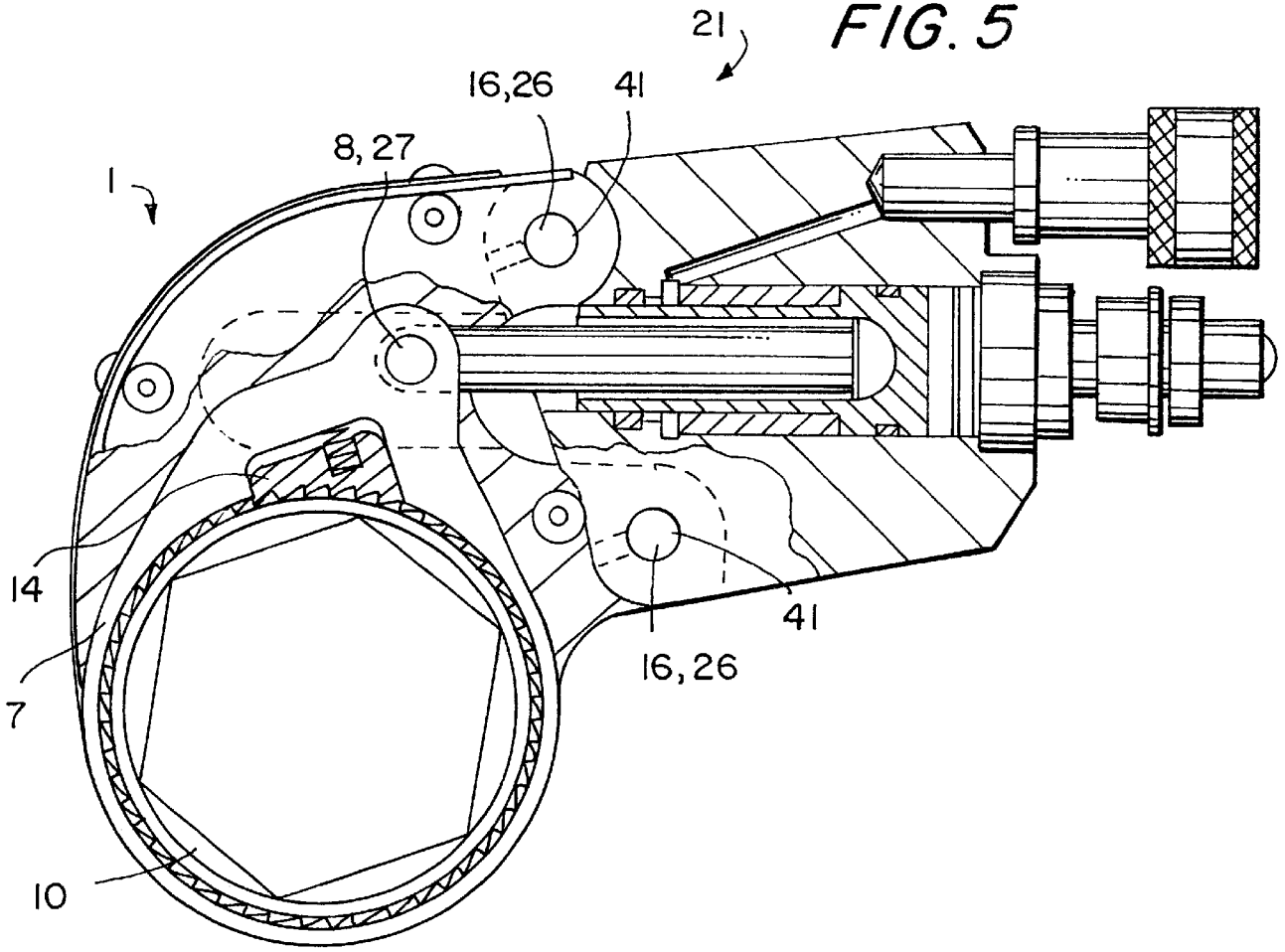
FIGS. 5 and 6 are a front view and a side view of the power tool of the present invention, with the drive means of the first embodiment connected to the link means.
Figure 6:
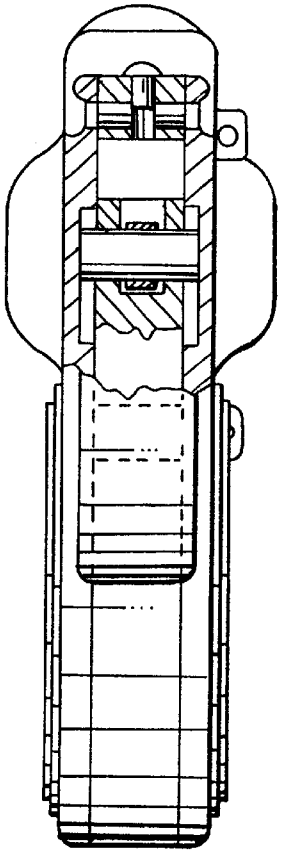
Figure 7:
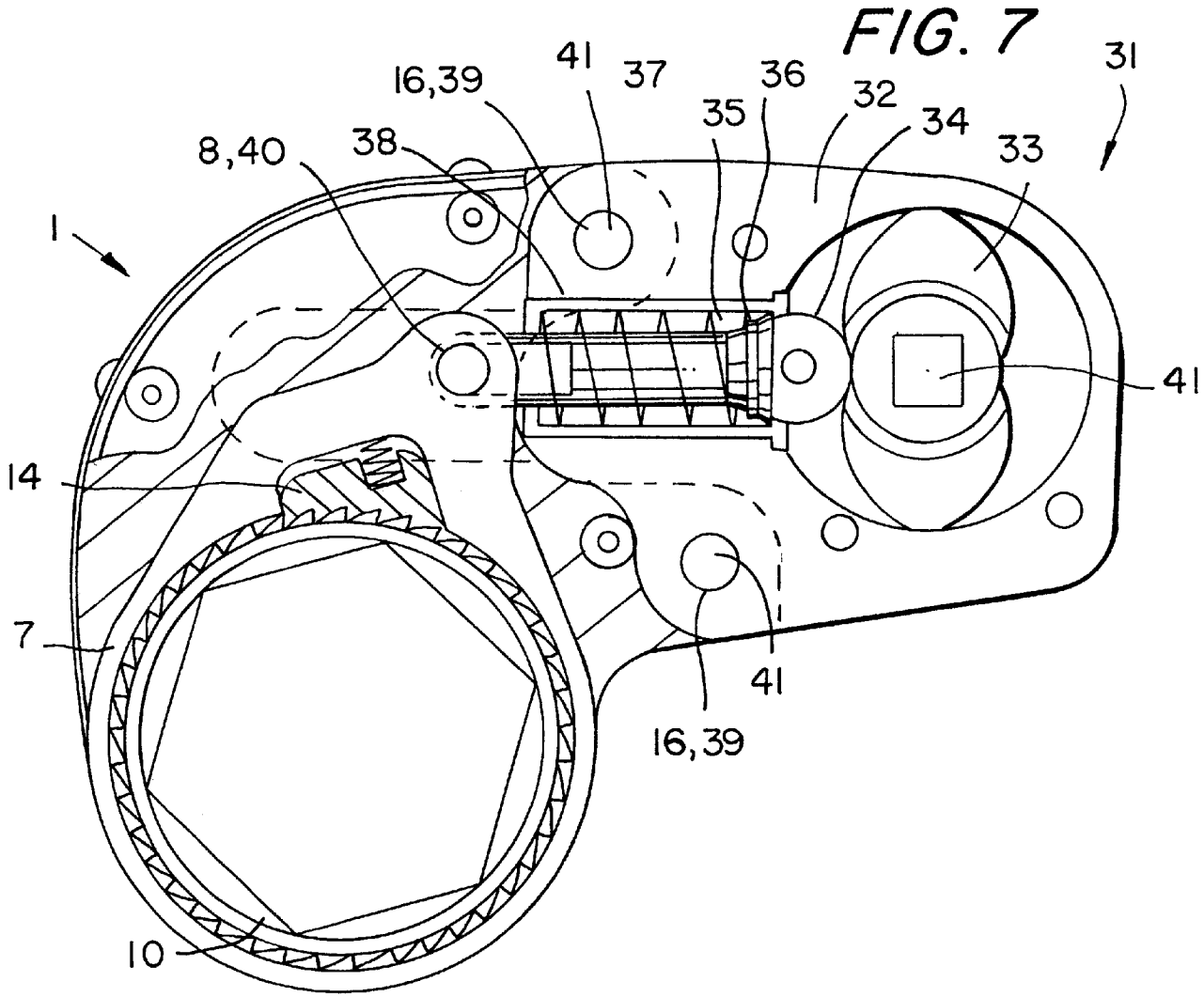
FIG. 7 is a side view of the inventive power tool with drive means of a second embodiment, connected to the same link.

A power tool in accordance with the present invention has a link which is identified as a whole with reference numeral I in FIGS. 1 and 2. The link has a housing which is composed of two housing plates 2 and 3 and a cover 4. The housing plates 2 and 3 are connected with one another by rivets 5, and the cover 4 is connected to the cover plates 2 and 3 also by rivets 6. The link 1 is further provided with a drive lever 7 which is turnably received in the plates 2 and 3 through a pivot pin 8 which is movable in grooves 9 provided in facing surfaces of the plates. A ratchet mechanism includes a ratchet 10 which is arranged turnably in the link 7 and has an inner engaging formation 11 which is formed for example as a hexagonal opening, a hexagonal shaft etc. The ratchet 10 has outer teeth 12 which are engageable with teeth 13 of a pawl 14. The pawl 14 is slidingly received in an opening of the drive lever 7 and spring biased by a spring 15 toward the ratchet 10. The link housing or in particular the plates 2 and 3 are provided with connecting means which include openings 16.

The power tool further has first drive means which are identified as a whole with reference numeral 21. The first drive means 21 is formed as a hydraulically operated drive means. The first drive means include a housing 22 which forms a hydraulic cylinder with a piston 23 reciprocatingly movable in it, and a driving element which is formed as a piston rod 24 connected with the piston 23. Hydraulic fluid is supplied to opposite chambers formed by the piston 23 in the cylinder 22 through hydraulic connecting elements 25 which are connected with a not shown hydraulic fluid source. The drive housing 22 is provided with connecting means which are formed by openings 26. The driving element or the piston rod 24 is also provided with connecting means 27 which can be formed as an opening.

When the power tool in accordance with the present invention operates as a hydraulically-operated power tool, the hydraulic drive housing 22 is connected with the link housing 1 by aligning the openings 16 with the openings 22 and passing corresponding connecting elements through the aligned openings, for example pins 41 and the like. The free end of the piston rod 24 of the hydraulic drive is connected to the pin 8 of the link means 1, for example by inserting the pin 8 into the opening 27. When a hydraulic fluid is supplied into the cylinder of the drive unit, the piston 23 is displaced and displaces the piston rod 24 which in turn turns the drive lever 7 and the pawl 14 arranged on it, the pawl 14 turns the ratchet 10, and the ratchet turns a threaded connector, such as for example a nut, a bolt head, etc., which is engaged by the engaging means 11 of the ratchet. A threaded fastener is tightened or loosened.

The power tool in accordance with the present invention has a second drive means which is identified as a whole with reference numeral 31. The second drive means has a housing 32, a cam 33 rotatable in the housing and formed for example as a double cam, a cam roller 34, and a driving member 35 which is formed for example as a cam rod and displaced during turning of the cam 33 through the roller 34 and a guide ring 36. The compression spring 37 located in a spring sleeve 38 operates as a return spring. The drive housing 32 has connecting means 39, while the cam rod 35 has connecting means 40 formed for example as openings.

When it is desirable to use a non-hydraulically operated power tool, a customer disconnects the hydraulically-operated drive means 21 from the link 1 and connects the drive means 31 to the link means 1 by aligning the openings 39 of the non-hydraulic drive means 31 with the openings 16 of the link 1 by passing connecting elements, such as pins 41 through the aligned openings. The connecting element 40, for example an opening at the end of the cam rod 35 is fitted over the pin 8 of the drive lever 7. When the cam is turning, the cam rod reciprocates and turns the drive lever 7 with the pawl 14, so that the pawl 14 turns the ratchet 10, and thereby a threaded connector engaged by the engaging means 11 of the ratchet 10 is turned as well.

The cam 33 is provided with third connecting means 41 formed for example as a polygonal (square) projection or opening. The third connecting means 41 can be engaged by an additional tool, such as for example a manual torque wrench, a cheater bar, a manual multiplier, an air wrench, an electric wrench, an electric multiplier, an impact wrench, etc., which a customer has in his possession, so as to turn the cam 33.

It will be understood that each of the elements described above, or two or more together, may also find a useful application in other types of constructions differing from the types described above.

While the invention has been illustrated and described as embodied in power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A power tool for tightening and loosening threaded connectors, comprising link means having a link housing, engaging means for engaging a threaded connector to be tightened and loosened, and ratchet means for turning said engaging means so as to turn a threaded connector engaged by said engaging means; hydraulic drive means including a drive housing, and a hydraulically operated drive provided with a hydraulically movable driving element; and non-hydraulic drive means including a drive housing, and a non-hydraulically operated drive provided with a non-hydraulically movable driving member; first connecting means provided on said link housing and on said drive housing of said hydraulic drive means and said non-hydraulic drive means, so that alternatingly either said housing of said hydraulic drive means or said housing of said non-hydraulic drive means can be connected with said link housing; and second connecting means for connecting said ratchet mechanism alternatingly with said driving element of said hydraulic drive means or said driving element of said non-hydraulic drive means when said drive housing of said hydraulic drive means is connected with said link housing or said drive housing of said non-hydraulic drive means is connected with said link housing correspondingly, so that said driving element of said hydraulic drive means and alternatingly said driving element of said non-hydraulic drive means during its movement turns said ratchet mechanism of said link means and thereby turns a threaded connector engaged by said engagement means of said link means to be tightened or loosened, said non-hydraulic drive means having at elast one turnable cam which acts on said driving element of said non-hydraulic drive means during turning; and further comprising third connecting means for connecting said at least one cam to a drive tool, so that when the drive tool is connected by said third connecting means to said cam and turns said cam, said cam acts on said driving element of said non-hydraulic drive means and the latter turns said ratchet mechanism to turn said engaging means and thereby to turn a threaded connector to be tightened or loosened.

* * * * *